United States Patent [19]

Klink et al.

[11] Patent Number: 4,802,331

[45] Date of Patent: Feb. 7, 1989

[54] GLASS FIBER BULK STRAND ROVING

[75] Inventors: Jerome P. Klink; Hellmut I. Glaser, both of Granville, Ohio

[73] Assignee: Owen-Corning Fiberglas Corporation, Toledo, Ohio

[21] Appl. No.: 98,914

[22] Filed: Sep. 21, 1987

Related U.S. Application Data

[62] Division of Ser. No. 44,182, Apr. 30, 1987, Pat. No. 4,741,151.

[51] Int. Cl.[4] ..... D02G 3/18; D02G 3/22; D02G 3/24; D02J 1/02

[52] U.S. Cl. ..... 57/246; 57/208; 57/249; 57/350

[58] Field of Search ..... 57/200, 2, 243, 249, 57/350, 204–208, 333, 351; 28/271–276

[56] References Cited

U.S. PATENT DOCUMENTS

| | | | |
|---|---|---|---|
| 2,719,350 | 10/1955 | Slayter et al. | 57/249 X |
| 2,719,352 | 10/1955 | Slayter et al. | 57/249 X |
| 2,795,926 | 6/1957 | Drummond | 57/297 X |
| 3,118,213 | 1/1964 | Benson | 57/246 X |
| 3,324,641 | 6/1967 | Benson et al. | 57/246 X |

*Primary Examiner*—John Petrakes

*Attorney, Agent, or Firm*—Patrick P. Pacella; Ronald E. Champion; Thomas A. Meehan

[57] ABSTRACT

A glass fiber bulk strand roving that is made up of a multiplicity of strands, each of which is made up of a plurality of individual fibers, for example, 200 of such fibers. Each strand of the roving has a multiplicity of rather long, axially extending loops, for example, axially extending loops with a calculated length of at least 6 inches, and a multiplicity of shorter, unbroken, cross-axially extending loops that are formed in the axially extending loops of such strands. The axially extending loops and the cross-axially extending loops interengage and intertwine with one another to form a composite entangled structure. The roving of the present invention is made by a process that uses a finger wheel to form axially extending loops in strands and a spinner downstream of the finger wheel. The looped strands from the finger wheel pass through a relatively unrestricted passage in the spinner which imparts a twist to such a looped strands, and then through a relatively restricted outlet orifice that is downstream of the outlet of the spinner. A back-up or puddling of the looped strands occurs in the spinner near the outlet thereof, due to the axial length of the loops in the strands and the restriction in the outlet of the spinner in the form of the outlet orifice, and this back-up or puddling of the looped strands in the spinner, in conjunction with the spinning thereof, results in the formation of the cross-axial loops in the axial loops of the strands.

13 Claims, 6 Drawing Sheets

GLASS FIBER BULK STRAND ROVING

This is a division, of application Ser. No. 07/044,182, filed Apr. 30, 1987, now U.S. Pat. No. 4,741,151.

TECHNICAL FIELD

This invention relates to a glass fiber bulk strand roving that is characterized by a relatively large number of unbroken cross-axial loops, in addition to the axial loops that are characteristic of prior art glass fiber rovings.

BACKGROUND ART

Glass fiber spun rovings are known in the prior art and are used as reinforcement materials in various types of thermoplastic products, such as the types of glass fiber reinforced plastic products that are produced by the pultrusion process. Such reinforced thermoplastic products are used, for example, as sucker rods in oil well drilling because of their relatively light weight and good longitudinal direction strength. Most glass fiber spun rovings that have been used as reinforcement materials for such reinforced thermoplastic products have been produced by a process corresponding to that which is described in U.S. Pat. No. 2,795,926 (W. W. Drummond), which is assigned to the assignee of this application. As described in the aforesaid U.S. Pat. No. 2,795,926, a main strand of glass fiber is caused to form multiple loops therein by passing it through a spinner to form a roving-like article, and the roving-like article is then combined with a group of primary filaments into a composite product. This composite product is rather expensive to produce, due partly to the fact that the primary filaments are relatively expensive because of their relatively low bulkiness, and due partly to the fact that the process is awkward and is not readily adaptable to standard production techniques or high throughput bushings.

Due to problems relating to the use of primary filaments and to the awkward nature of the process that was associated with the manufacture of roving-like glass fiber products according to the teachings of the aforesaid U.S. Pat. No. 2,795,926, an alternative spun roving product, and method and apparatus for the manufacture thereof, was developed and U.S. Pat. No. 3,324,641 (G. E. Benson, et al.), also assigned to the assignee of this application, was granted thereon. According to U.S. Pat. No. 3,324,641, a spun roving glass fiber product can be produced without the need for a separate source of supply of primary filaments, by passing a strand through a peg wheel spinner to form multiple axially extending loops therein and then through a spinning, frustoconically shaped spinner, from the large end to the small end thereof, to cause the axially extending loops to intertwine and interlock with one another. However, the process of the aforesaid U.S. Pat. No. 3,324,641 was not effective in forming a spun roving glass fiber product with a significant number of cross-axial loops, and did not gain widespread commercial acceptance except in regard to the manufacture of decorative yarn. Further, the process of the aforesaid U.S. Pat. No. 3,324,641 employed an air tucker to direct high velocity air in an annular pattern against the product to enhance the texturizing of the product, which is an important characteristic in a decorative yarn product. However, it has been found that this air tucker frequently results in the fracturing of some of the loops of the product and this is a factor which detracts from the tensile strength of the product.

DISCLOSURE OF THE INVENTION

According to the present invention, there is provided a glass fiber roving product which has a relatively large number of unbroken cross-axial loops, in addition to the axial loops that are characteristic of prior art spun rovings, and which, as a consequence of the relatively large number of cross-axial loops, has a high bulk factor which results in a high degree of improvement in the properties of a plastic product that is reinorced with such a roving product for a given weight of glass fiber therein. Further, as a consequence of the fact that a relatively large number of the cross-axial loops of the high bulk roving product of this invention are unbroken, a plastic product that is reinforced with such a high bulk roving will have enhanced strength characteristics in the cross-axial direction. The high bulk roving according to the present invention does not need any center strand corresponding to the primary filaments of the roving-like product of the aforesaid U.S. Pat. No. 2,795,926, which, desirably, enhances the bulkiness of the product of this invention for a given weight of glass fibers, and permits the product of this invention to be produced by techniques that are quite compatible with standard production techniques and with high throughput bushings, and, thus, at a very competitive manufacturing cost.

The method and apparatus for the manufacture of a high bulk roving according to the present invention employs a finger wheel that rotates in a horizontal plane to form axial direction loops in vertically moving split glass fiber strands, and a high speed spinner downstream of the finger wheel to cause the axially looped portions of the strands to intertwine with one another and to interengage with one another and to form a twist in such axially looped strands. The spinner has an enlarged chamber portion near the outlet therefrom and a restricted outlet orifice near such spinner outlet. This arrangement causes the spinning, axially looped glass fiber strands in the spinner to "puddle" at a location near the outlet from the spinner, a factor which, in conjunction with the centrifugal forces that result from the spinning of the spinner, results in the formation of a substantial number of cross-axial loops in the axially extending loops. The cross-axial loops serve to intertwine and interengage with one another and with the axial loops to form a securely entangled, but very open, and a very high bulk or low density type of roving. Further, since the linear speed of the roving leaving the spinner is considerably less than the linear speed of the split glass fiber strand entering the spinner, the process yield, which is the ratio of the linear outlet speed to the linear inlet speed, is quite low, which indicates that the material that is passing through the process experiences a high degree of bulking during the process.

The roving of the present invention exits from the spinner used in its manufacture through an orifice by which the roving may be impregnated with an organic sizing material, or a solution thereof, based on the desired end use of the material. Preferably, the orifice is constructed with an internal opening that is variable in size, for example, by constructing it in the form of an iris, to facilitate the start-up of the process and to simplify the unblocking of the process in the event of a blockage of the split glass fiber strand passing through the spinner or orifice. A glass fiber bulk strand roving according to the present invention may be used to advantage to reinforce plastic products that are produced by the pultrusion process, for example, for fabrication into oil well sucker rods, chemical grating cross members and highway dowel bars, and to reinforce shaped pultruded plastic products such as highway delineators, structural beams and other parts with small radii. Further, it is also contemplated that glass fiber bulk strand rovings according to the present invention can be used as a winding material for filament wound pipe, in compression molded laminates such as leaf springs and bumpers, in ballistic laminates, in woven fabrics for the production of large fiberglass reinforced plastic parts or as a layered substitute for woven fabrics for such parts, and in other applications requiring a lightweight material with good multiaxial strength properties.

Accordingly, it is an object of the present invention to provide a new and improved glass fiber roving product. More particularly, it is an object of the present invention to provide a glass fiber roving product which has a relatively large number of unbroken, cross-axial loops in addition to multiple axial loops, and which can be manufactured on a high throughput basis.

For a further understanding of the present invention and the objects thereof, attention is directed to the drawing figures and the following brief description thereof, to the best mode contemplated for carrying out the present invention and to the appended claims.

DESCRIPTION OF THE DRAWING FIGURES

BEST MODE FOR CARRYING OUT THE INVENTION

Figure 1:
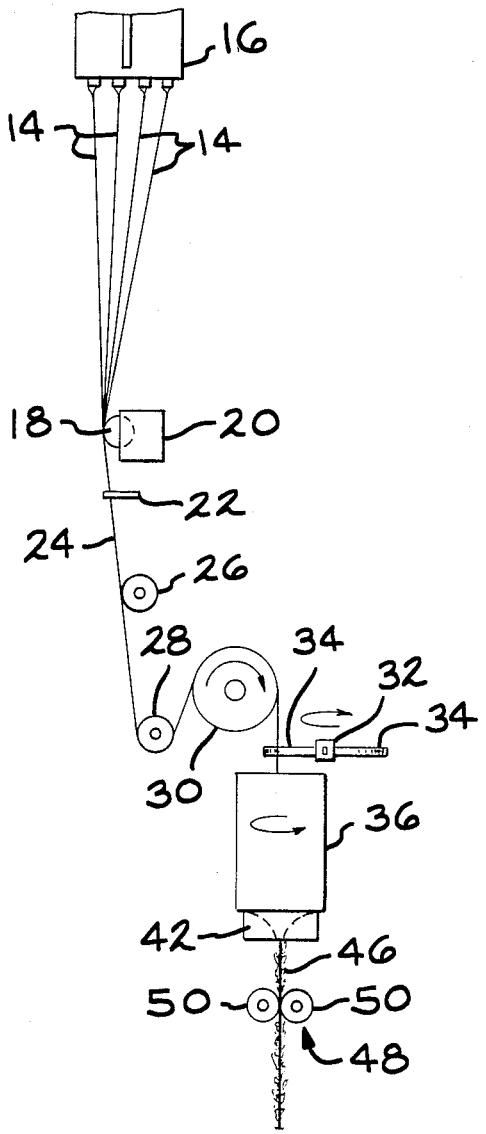
FIG. 1 is an elevational fragmentary schematic view of an apparatus for producing a glass fiber roving product according to the present invention.

As is shown in FIG. 1, glass fibers 14 are drawn continuously from a pool of molten glass, not shown, in a bushing 16, which is shown fragmentarily and which may be of conventional construction. The glass fibers 14 are wetted with a suitable primary sizing compound by passing them over a sizing applicating roller 18 that rotates through a body of liquid sizing compound which is maintained in a housing 20, in a customary manner. The primary sizing material normally is an aqueous solution which contains a coupling agent with some lubricant to facilitate the further handling of the glass fibers in the apparatus of the present invention.

The glass fibers 14, after the application of the sizing compound thereto, are passed over a splitter 22 where a multiplicity of split strands 24 are formed, each of such split strands being made up of a multiplicity of individual glass fibers 14. Preferably, each split strand 24 comprises at least 50 glass fibers, and even more preferably, each split strand comprises approximately 200 glass fibers, a number which has been found to be useful in producing a glass fiber roving product for use as a reinforcement in a plastic rod produced by the pultrusion process from a 1600 tip bushing by combining the 1600 fibers from the bushing into 8 split strands. The advance of the glass fibers 14 to the splitter 22 and the advance of the split strands 24 from the splitter 22 is accomplished by means of a driven pull wheel 30, a guide roll 26 and an idler roll 28 being provided, in succession, between the splitter 22 and the pull wheel 30. The split strands 24 leaving the pull wheel 30 are caused to form loops that extend axially of the split strands by passing the split strands through a rotating finger wheel 32 which includes a plurality of generally radially and downwardly extending fingers 34 for temporarily engaging and suspending the forward progress of the split strands 24 to form axially extending loops in the split strands. The axially looped split strands emerge from the tips of the fingers 34 of the finger wheel 32 and pass into the interior of a generally cylindrical spinner 36 which is rotated at a relatively high speed. The axially looped split strands 24 which pass from the finger wheel 32 into the spinner 36 are caused to adhere to the inside surface 38 of the spinner 36 by virtue of the centrifugal force imparted to such axially looped split strands by the rotation of the spinner 36, and, to some extent, by surface tension resulting from the sizing compound that was applied to the glass fibers 14 by the sizing applicating roller 18. Further, if need be, the upper portion of the inside surface 38 of the spinner 36 can be provided with shallow, vertically extending grooves 40 to ensure good initial contact between the inside surface 38 of the spinner 36 and the axially looped split strands that pass through the spinner 36, to thereby ensure the proper removal of the split strands from the finger wheel 32 by the spinner 36. The spinning of the axially looped split strands that pass through the spinner 36 causes a twist to be imparted to all of such split strands, and it causes individual split strands to be moved from side to side relative to one another to help to provide an interengaging or intertwining relationship between such split strands to help form a composite, entangled structure therebetween.

As the axially looped split strands pass from the bottom of the spinner 36 they are caused to impinge against a surface by passing them through an outlet orifice 42 whose diameter is substantially less than the diameter of the bottom of the spinner, for example, the inside diameter of the spinner 36 may be four inches (4.0 in.) while the inside diameter of the outlet orifice may be one-half inch (0.5 in.). The outlet orifice 42 is positioned very close to the bottom of the spinner and it may be provided with interior passages 44 for the application of a secondary sizing compound to the product, now in the form of a roving 46, which passes therefrom. The secondary sizing compound is, typically, a binder, and this binder can be any of various known types depending on the desired end use for the roving 46, as is known in the art. The speed of advance of the axially looped split strands passing from the bottom of the spinner is controlled, in relationship to the number of such loops, by controlling the tip speed of the driven pull wheel 30 in relationship to the rotational speed of the finger wheel 32 and the number of fingers 34 of the finger wheel, so that the axial length of each of the axially extending loops is greater than the distance between the tips of the fingers and the restriction at the bottom or outlet from the spinner 34.

The relationship between the length of the axially extending loops, as described, and the restriction at the outlet from the spinner 36 in the form of the outlet orifice 42, causes the axially looped split strands that pass through the spinner 36 to puddle up in a mass at the bottom of the spinner 36. While the axially looped splits are in this spinning mass, portions of individual loops are caused to further loop outwardly in a cross-axial direction by virtue of the centrifugal force that such axially looped split strands experience in the spinner 36, especially while they are in the puddled up mass at the bottom where such axially looped splits are experiencing no appreciable forward axial motion, and these cross-axial loops further interengage or intertwine with one another and with other axially extending loops to further help to form an entangled, composite structure in the form of the roving 46 out of all of the axially looped split strands that enter the spinner 36.

The roving 46 exits from the spinner 36 under the influence of the pull roll assembly 48 which is made up of counterrotating pull rolls 50. From the pull roll assembly 48 the roving 46 passes to equipment, not shown, for further processing of the roving 46, for example, to equipment for drying and packaging the roving 46.

Figure 3:
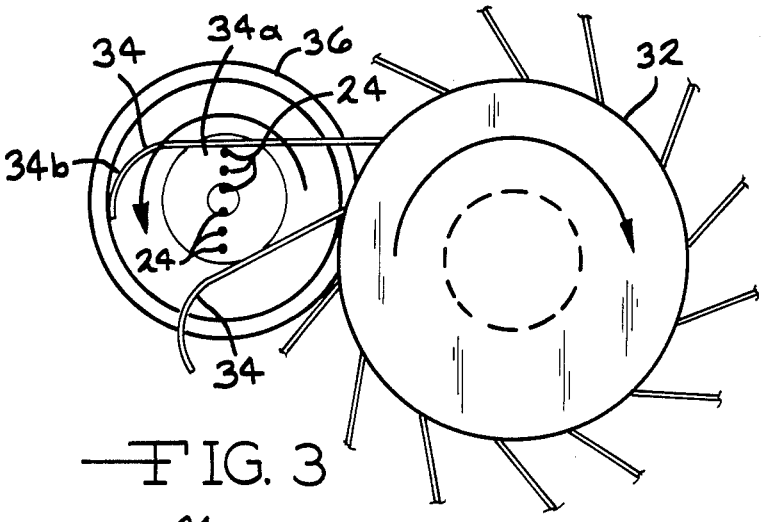
FIG. 3 is a fragmentary plan view, at an enlarged scale, of a portion of the apparatus illustrated in FIG. 1.
Figure 6:
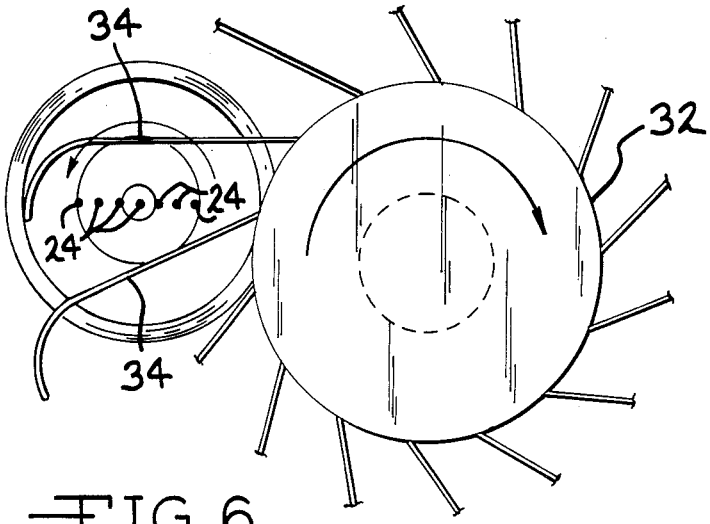
FIG. 6 is a view similar to FIGS. 3 and 5 showing yet another alternative mode of using the apparatus illustrated therein.
Figure 5:
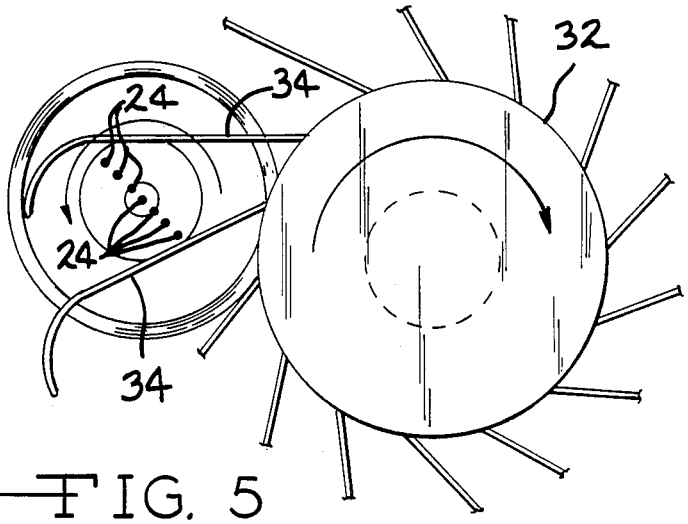
FIG. 5 is a view similar to FIG. 3 showing an alternative mode of using the apparatus illustrated in FIG. 3.

As is shown in FIG. 3, each of the fingers 34 of the finger wheel 32 has a relatively straight inner portion **34*a* and a curved tip portion 34*b*. The finger wheel 32 and the spinner 36 are so configured and oriented with respect to one another that the inner portion 34*a* of each finger 34 extends generally diametrically of the spinner 36 as it passes the thereabove, and the curved portion 34*b* of each of the fingers 34 curves away from the direction of rotation of the finger wheel 32 and terminates in tangential alignment above the inside surface 38 of the spinner 36 when the finger is approximately at the midpoint of its passage above the spinner 36. This configuration and orientation results in a very smooth transistion of each split strand 24 from the finger wheel 32 to the inside surface 38 of the spinner 36. Further, as shown in FIG. 3, itis preferred that the orientation of the split strands 24, with respect to the fingers 34 of the finger wheel 32, be in a straight line that extends generally perpendicularly of the orientation of the finger 34 which is at the midpoint of its passage above the spinner 36. Alternatively, as is shown in FIG. 5, the orientation of the split strands 24 with respect to the fingers 34 of the finger wheel 32 may be in a straight line that extends obliquely of the finger 34 which is at the midpoint of its passage above the spinner 36 or, as is shown in FIG. 6, in a straight line that extends generally parallel to the finger 34 which is at the midpoint of its passage above the spinner 36**.

Figure 9:
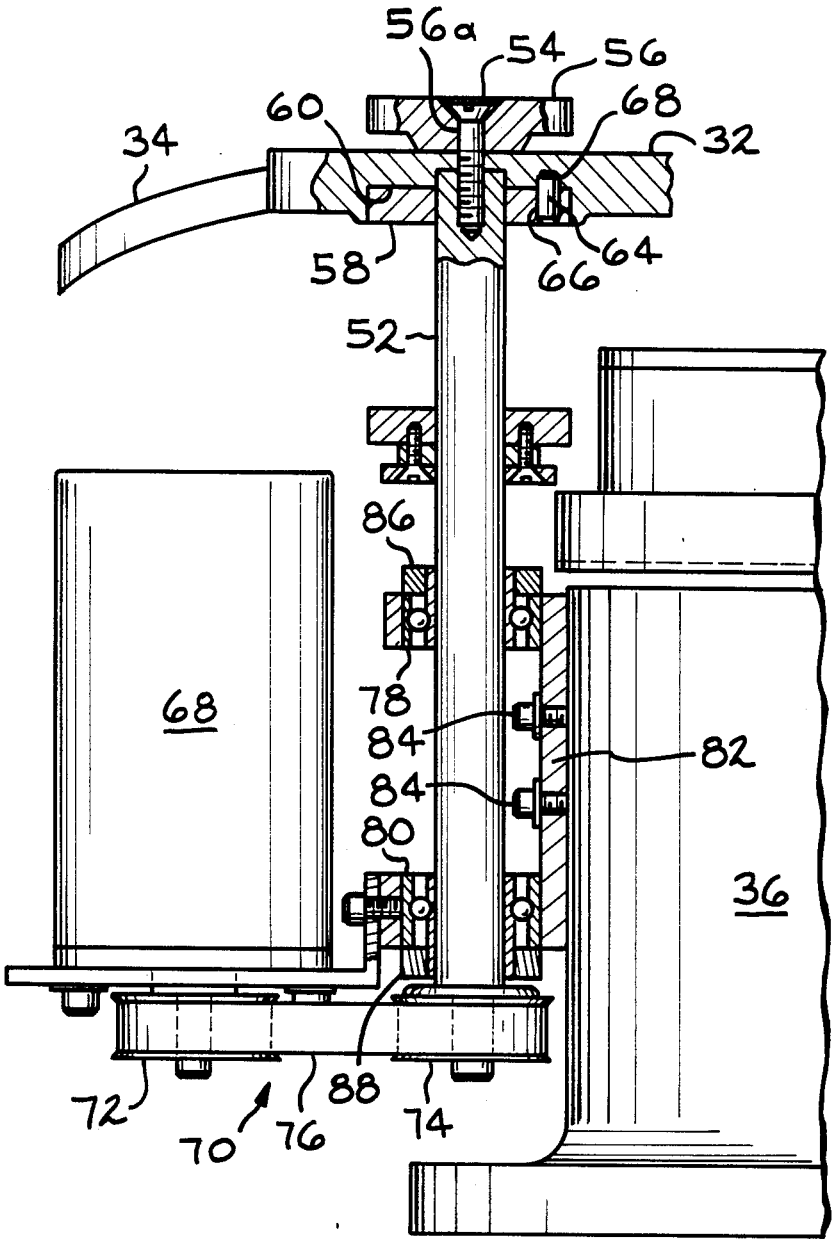
FIG. 9 is a fragmentary elevational view, partly in section and at an enlarged scale, of a preferred embodiment of a portion of a apparatus that is illustrated schematically in FIG. 1.
Figure 10:
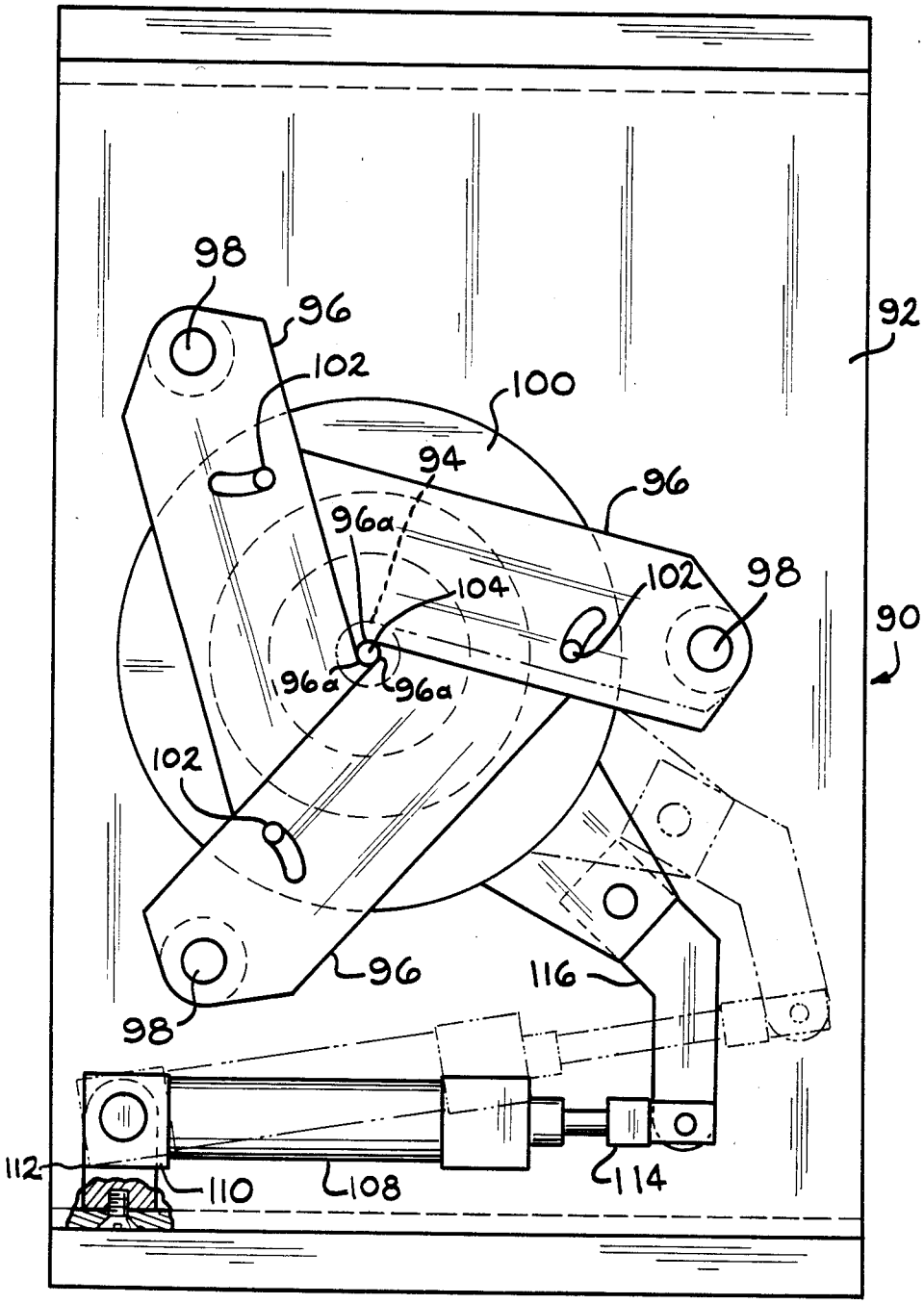
FIG. 10 is a plan view of a variable diameter, iris-type orifice assembly that may be used in the practice of the present invention.

The structure of the finger wheel 32 and its relationship to the spinner 36 is shown in more detail in FIGS. 9 thru 11. As is shown most clearly in FIG. 9, the finger wheel 32 is attached to the free end of a shaft 52 by a threaded fastener 54, preferably a flat head screw which is threadably received in the shaft 52. The threaded fastener is received in a hold down member 56, the underside of which bears against the top of the finger wheel 32, the hold down member having a countersunk aperture **56*a* which receives the threaded fastener 54. To help to stabilize the position of the finger wheel 32 with respect to the shaft of 52, the shaft 52 is provided with a collar 58 near the free end thereof and the finger wheel 32 is provided with a recess 60 that snugly receives the collar 58. An aligning pin 62 is provided to align a double-ended hole 64 in the collar 58 with a blind hole 66 in the finger wheel 32 to help to ensure proper circumferential orientation of the finger wheel 32 with respect to the shaft 52. If desired, the aligning pin 62 can be a shear pin that is designed to fail before an overload torque can be imposed on the shaft 52**.

As is clear from FIG. 9, each finger 34 of the finger wheel 32 extends downwardly at an oblique angle toward the spinner 36. This orientation of each finger 34 further contributes to a very smooth transition of each split strand 24 as it passes from the finger wheel 32 to the spinner 36.

The rotation of the shaft 52 and, thus, the rotation of the finger wheel 32 which is attached thereto, as heretofore described, is powered by a conventional electric motor 68 through a conventional V-belt drive 70 that includes a drive pulley 72 which is non-rotatably attached to the output shaft of the motor 68, a driven pulley 74 which is non-rotatably attached to the shaft 52, and a drive belt 76 which is snugly trained around the drive pulley 72 and the driven pulley 74, the shaft 52 being rotatably supported at a pair of spaced apart locations between the driven pulley 74 and the finger wheel 32 by bearing members 78 and 80. The bearing members 78 and 80 are attached to a mounting plate 82 which is secured to the extension of the spinner 36 by bolts 82. The shaft 52 is longitudinally positioned relative to the bearing members 78 and 80 by means of collars 86 and 88 which are attached to the shaft 52 and which, respectively, engage the top side of the bearing 78 and the bottom side of the bearing 80.

Figure 2:
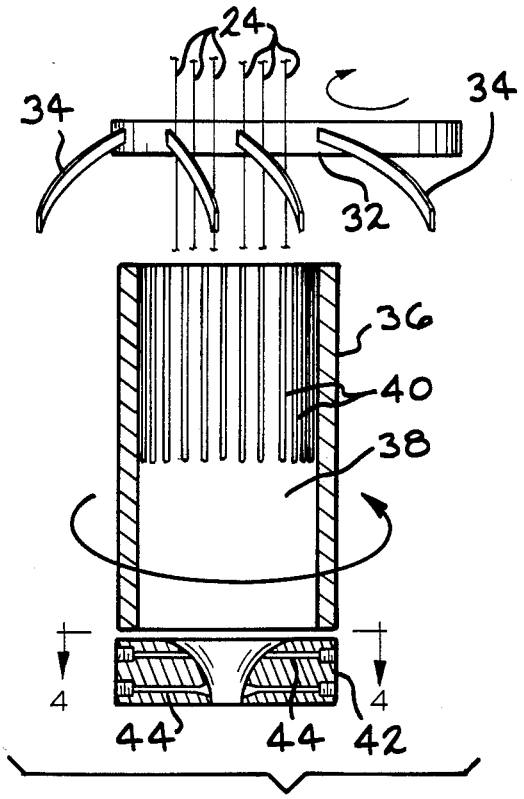
FIG. 2 is an elevational view, partly in section and at an enlarged scale, of a portion of the apparatus illustrated in FIG. 1.
Figure 4:
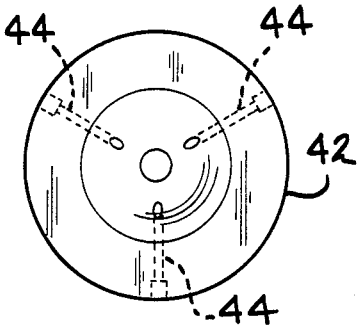
FIG. 4 is a view taken on line 4—4 of FIG. 2.

As heretofore explained, the size of the outlet orifice at the bottom of the spinner 36 preferably is variable in size, between a small size when the process is being operated in an equilibrium condition and a larger size to facilitate the start-up of the process or the unblocking of the process in the event of a blockage of the split glass fiber strand passing through the spinner or the outlet orifice. This result can be accomplished by an outlet structure which incorporates an orifice assembly 90, as is shown in FIG. 11, which can be used in place of the outlet orifice 42 of the embodiment of FIGS. 1 and 2.

The orifice assembly 90 includes a fixed plate 92 with an aperture 94 therein. A plurality of arms 96, shown as three, are pivotally attached to the fixed plate 92, each arm being pivotable about an axis 98. Each axis 98 is spaced equidistantally from the aperture 94 and the arcuate spacing between adjacent axis 98 is equal, viz., 120° in the case of an orifice assembly 90 that includes three arms 96. Each of the arms 96 is also pivotally attached to an annular plate 100 which is positioned adjacent to and parallel to the fixed plate 92 and which surrounds the aperture 94. The attachment of each of the arms 96 to the annular plate 100 is by means of a pin 102 in each arm which is received in an arcuate guide slot 104 in the annular plate 100. Each of the arms 96 has a radially innermost curved portion **96*a* and the curved portions 96a, collectively, define an aperture 106 through which the bulked strands from the spinner must pass. By virtue of the pivotal attachment of the arms 96 to the annular plate 100, as heretofore described, this aperture 106 can be varied in size, to provide an aperture 106 with either a predetermined minimum size or a predetermined maximum size by oscillating the annular plate 100 about the longitudinal axis of the aperture 94, which is coaxial with the longitudinal axis of the aperture. Such oscillation can be conveniently actuated by a double acting pneumatic cylinder 108, a clevis end 110 of which is pivotally attached to a bracket 112 which is affixed to the plate 92 and a rod end 114 of which is pivotally attached to an arm 116 which is attached to the annular plate 100**.

In the operation of the process and apparatus of the present invention, one of the important process variables is the bulking factor (BF) which is determined by the number of split strands (N), the turn down ratio of the system (TDR) and the loop formation ratio of the product (LFR) according to the following formula:

$$BF = N \times TDR \times LFR$$

In this formula, the turn down ratio (TDR) is equal to the pull wheel lineal speed divided by the pull roll lineal speed, assuming no slippage, or in other words, the input yardage per unit of time divided by the output yardage per unit of time, and the loop formation ratio (LFR) is equal to the theoretical amount of glass in the cross-axial direction divided by the theoretical amount of glass in the axial direction. This loop formation ratio can be determined by the pull wheel lineal speed, in feet per minute (PWS), the finger wheel tip speed, in feet per minute (FWS), the number of fingers in the finger wheel (NF), and the longitudinal distance, in feet, from the tips of the fingers of the finger wheel to the bottom of the spinner (D) according to the following formula:

$$LFR = \frac{\frac{PWS}{FWS \times NF} - 2D}{2D}$$

Based on the foregoing process parameters, the process has been practiced quite successfully using a seven finger finger wheel and using both eight split strands and twenty split strands at bulking factors (BF) in the range from 40 to 800. Generally speaking, higher bulking factors (BF) are achieved at lower yields, for example, bulking factors in the range from 120 to 800 are readily achieved at a yield, in yards per pound, of 10 while, conversely, lower bulking factors are achieved at higher yields, for example, bulking factors in the range from 40 to 90 are readily achieved at a yield of 80. Some runs have been conducted at values outside of these ranges, but, generally speaking, the results are consistently better when the operation is conducted within the foregoing ranges.

The process and apparatus according to the present invention can be closely controlled to control the loop formation ratio of the bulk strand roving produced thereby within a fairly wide range of loop formation ratios, and this is important since the properties of the various end products which incorporate a bulk strand roving can be optimized by having a bulk strand roving with a particular loop formation ratio that is ideal for each such product. For example, the process and apparatus according to the present invention can be controllably operated within a preferred loop formation ratio range of approximately 0.3 to 1.3. A bulk strand roving with a loop formation ratio of approximately 0.3 has been found to be well-suited as a reinforcing material for a plastic product that is produced by the pultrusion process, and, in general, bulk strand rovings with higher loop formation ratios are capable of containing higher amounts of thermoplastic resin in various types of fiberglass reinforced thermoplastic products.

THE WAY IN WHICH THE INVENTION IS CAPABLE OF EXPLOITATION IN INDUSTRY

Figure 7:
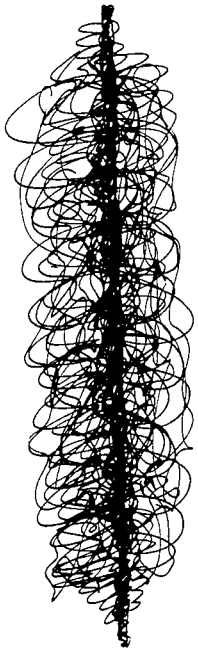
FIG. 7 is a fragmentary view, in elevation, of an embodiment of a glass fiber roving product according to the present invention.
Figure 8:
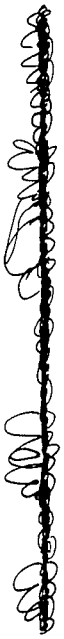
FIG. 8 is a fragmentary elevational view of an alternative embodiment of a fiber glass roving product according to the present invention.

The bulk strand roving product of the present invention is capable of being produced in a wide variety of sizes and degrees of bulkiness by means of the method and apparatus of the present invention and, thus, is useful for many product reinforcing applications that previously utilized various types of spun roving products. Specifically, it is contemplated that such bulk strand roving products can be produced from standard glass fiber strands from G through M in filament diameter (9.14 um through 15.80 um) and in yields from 110-5 yds/lb. Further, such products can be produced with a very open structure which, in the high yield range, show a tendency to draft or they can be produced in a very tightly twisted structure. They can be made with axial loops of varying length, the calculated length of each of such axial loops varying from 6–32 inches, with a preferred length of approximately 10–15 inches and with cross-axial loops of varying diameter and varying mass content in relationship to the mass of the axial loops. As is shown in FIG. 7, the cross-axial loops can be tucked in to provide a more integral bundle or they can be left to protrude from the composite roving product, as is shown in FIG. 8, to provide a more open product with increased cross-axial tensile strength characteristics. The twist imparted to such bulk strand roving product can be in the range of 0.2–1.0 turns per inch. Additionally, since the process for the production of such bulk strand roving product as described is compatible with conventional glass fiber production processes, it can be employed using the output of a commercial size high throughput bushing, for example, a bushing having 3200 tips with a production rate of up to approximately 150 lbs./hour.

Various modifications of the above-described embodiments of the invention will be apparent to those skilled in the art, and it is to be understood that such modifications can be made without departing from the scope of the invention, if they are within the spirit and the tenor of the accompanying claims.

What is claimed is:

1. A bulk strand roving product comprising: a plurality of strands, each of said strands comprising a plurality of fibers, each of said strands having a plurality of axially extending loops and a plurality of unbroken, cross-axially extending loops formed therein, said axially extending loops and said cross-axially extending loops being interengaged and interwined with one another to form an entangled structure.

2. A bulk strand roving product according to claim 1 wherein said bulk strand roving product has a twist imparted thereto.

3. A bulk strand roving product according to claim 2 wherein said bulk strand roving product has a twist in the range of approximately 0.2–1.0 turns per inch imparted thereto.

4. A bulk strand roving product according to claim 1 wherein each of such plurality of strands comprises a plurality of fibers of a heat-softenable material.

5. A bulk strand roving product according to claim 4 wherein said heat-softenable material is glass.

6. A bulk strand roving product according to claim 1 wherein each of said axially extending loops of each of said strands has a calculated length of at least approximately 6 inches.

7. A bulk strand roving product according to claim 6 wherein each of said axially extending loops of each of said strands has a calculated length in the range of approximately 6–32 inches.

8. A bulk strand roving product according to claim 7 having a ratio of the theoretical amount of material in said cross-axially extending loop to the theoretical amount of material in said axially extending loops of at least approximately 0.3.

9. A bulk strand roving product according to claim 8 wherein said ratio is in the range of approximately 0.3 to 1.3.

10. A bulk strand roving product according to claim 1 wherein each of said plurality of strands comprises a plurality of fibers of glass, wherein each of said axially extending loops of said each of said plurality of strands has a calculated length of at least 12 inches, wherein each of said plurality of fibers of glass has a diameter in the range of approximately 9–16 um, and wherein said bulk strand roving product has a yield in the approximate range of 110 to 5 yards/pound.

11. A bulk strand roving product according to claim 10 wherein said bulk strand roving product has a twist in the range of approximately 0.2–1.0 turns per inch imparted thereto.

12. A bulk strand roving product according to claim 11 wherein said each of said plurality of strands comprises at least approximately 200 fibers of glass.

13. A bulk strand roving product according to claim 10 wherein said yield is in the approximate range of 80 to 10 yards/pound.

* * * * *